US009621995B2

(12) United States Patent
Yang

(10) Patent No.: US 9,621,995 B2
(45) Date of Patent: Apr. 11, 2017

(54) VIBRATING ELEMENT

(71) Applicant: Bill Yang, Taipei (TW)

(72) Inventor: Bill Yang, Taipei (TW)

(73) Assignee: COTRON CORPORATION, Taipei (TW)

( * ) Notice: Subject to any disclaimer, the term of this patent is extended or adjusted under 35 U.S.C. 154(b) by 0 days.

(21) Appl. No.: 14/451,431

(22) Filed: Aug. 5, 2014

(65) Prior Publication Data

US 2015/0350791 A1 Dec. 3, 2015

(30) Foreign Application Priority Data

May 27, 2014 (TW) ..... 103118434 A

(51) Int. Cl.
*H04R 25/00* (2006.01)
*H04R 9/04* (2006.01)
(Continued)

(52) U.S. Cl.
CPC ..... *H04R 9/046* (2013.01); *H04R 7/122* (2013.01); *H04R 7/125* (2013.01); *H04R 7/26* (2013.01);
(Continued)

(58) Field of Classification Search
CPC . H04R 7/125; H04R 7/20; H04R 9/02; H04R 9/063; H04R 2307/201; H04R 7/12;
(Continued)

(56) References Cited

U.S. PATENT DOCUMENTS 4,132,872 A * 1/1979 Inoue ..... H04R 7/14 181/165
4,979,220 A * 12/1990 Chen ..... H04R 1/025 381/403
(Continued)

FOREIGN PATENT DOCUMENTS

| | | |
|---|---|---|
| DE | 102012223590 | 2/2014 |
| JP | 3049570 | 6/2000 |
| KR | 1020140061200 | 5/2014 |

OTHER PUBLICATIONS

"Office Action of Korean Counterpart Application with English translation", issued on Jul. 27, 2015, p. 1-p. 7, in which the listed references were cited.
(Continued)

*Primary Examiner* — Davetta W Goins
*Assistant Examiner* — Phylesha Dabney
(74) *Attorney, Agent, or Firm* — Jianq Chyun IP Office

(57) ABSTRACT

A vibrating element including a diaphragm, a voice coil and a stiffening layer is provided. The diaphragm has a first surface and a second surface opposite to each other. The first surface includes a first conductive region and a second conductive region. The voice coil is disposed on the first surface. Two ends of the voice coil are electrically connected to the first conductive region and the second conductive region. The stiffening layer is disposed on the diaphragm. The diaphragm has a center region, which is enclosed and circled by the voice coil and includes an area of the diaphragm above the voice coil. The region outside the center region includes an inner circled zone and an outer circled zone surrounding the inner circled zone. At least one end of the voice coil is located in the inner circled zone and the stiffening layer covers the inner circled zone.

20 Claims, 15 Drawing Sheets

(51) Int. Cl.

| | |
|---|---|
| ***H04R 9/06*** | (2006.01) |
| ***H04R 7/12*** | (2006.01) |
| ***H04R 7/26*** | (2006.01) |
| *H04R 1/06* | (2006.01) |
| *H04R 7/02* | (2006.01) |

(52) U.S. Cl.
CPC ..... *H04R 9/06* (2013.01); *H04R 1/06* (2013.01); *H04R 7/02* (2013.01); *H04R 2307/027* (2013.01); *H04R 2307/201* (2013.01)

(58) Field of Classification Search
CPC ..... H04R 7/127; H04R 9/046; H04R 9/06; H04R 2307/023; H04R 2307/027; H04R 31/003; H04R 7/122; H04R 7/14; H04R 1/025; H04R 1/1016; H04R 1/1075; H04R 7/26; H04R 7/16; H04R 7/18; H04R 7/02
USPC ..... 381/396, 397, 398, 407, 395; 181/157, 181/172, 168
See application file for complete search history.

(56) References Cited

U.S. PATENT DOCUMENTS

| | | | | | |
|---|---|---|---|---|---|
| 5,148,492 | A * | 9/1992 | Uzawa | H04R 9/08 | 181/166 |
| 5,583,944 | A * | 12/1996 | Morohoshi | H04R 9/045 | 381/400 |
| 5,625,699 | A * | 4/1997 | Yamada | H04R 3/14 | 381/412 |
| 6,111,969 | A * | 8/2000 | Babb | H04R 9/063 | 381/396 |
| 6,236,733 | B1 * | 5/2001 | Kato | H04R 9/02 | 181/164 |
| 6,327,372 | B1 * | 12/2001 | Devantier | H04R 7/125 | 181/167 |
| 6,404,897 | B1 * | 6/2002 | Devantier | H04R 7/125 | 381/426 |
| 8,646,570 | B2 * | 2/2014 | Akino | H04R 7/125 | 181/167 |
| 2006/0256996 | A1 * | 11/2006 | Baeten | H04R 7/12 | 381/395 |
| 2008/0159583 | A1 * | 7/2008 | Tanaka | H04R 1/24 | 381/398 |
| 2010/0183173 | A1 | 7/2010 | Teske-Fischer et al. | | |
| 2013/0043090 | A1 | 2/2013 | Akino | | |

OTHER PUBLICATIONS

"First Office Action of Germany Counterpart Application", issued on Nov. 15, 2016, p. 1-p. 5, in which the listed references were cited.

* cited by examiner

VIBRATING ELEMENT

CROSS-REFERENCE TO RELATED APPLICATION

This application claims the priority benefit of Taiwan application serial no. 103118434, filed on May 27, 2014. The entirety of the above-mentioned patent application is hereby incorporated by reference herein and made a part of this specification.

BACKGROUND

Technical Field

The invention relates to a vibrating element, and particularly relates to a vibrating element adapted for a speaker unit.

Related Art

Along with development of technology, electronic products are developed towards a trend of miniaturization, and people can use the miniaturized electronic products, for example, radios, walkmans, etc., at anytime anywhere. Moreover, as personal digital products are gradually popularised, the commonly used MP3, mobile phones, personal digital assistants (PDAs) or notebooks, etc. become indispensable in daily life. Moreover, smart phones capable of providing various audio and video entertainments are more popular products.

Regardless of the type of the aforementioned electronic products, in order to facilitate a user hearing audio information provided by the electronic product without interrupting others, earphone becomes a necessary accessory of the electronic product. Moreover, the earphone also provides the user a better sound transmission, such that the user can clearly hear and learn the sound content unlike a situation of hearing unclear sound in case that the sound is transmitted through air, especially when the user is in a motion state, for example, doing sports, driving, conducting intense activities, or in a noisy environment.

In a speaker unit of a conventional earphone, circuit lines connected to two ends of a voice coil used for driving a diaphragm directly cross over the diaphragm and are connected to a signal source at periphery of the diaphragm. Moreover, the circuit lines are coated with a wire protection glue. Therefore, the voice coil crossing over the diaphragm severely influences vibration of the diaphragm, such that frequency response of the speaker unit is degraded, which leads to a poor sound quality performance.

FIG. 1 is a schematic diagram of a speaker unit in U.S. Patent Application No. US 2010/0183173. Referring to FIG. 1, the voice coil 20 is directly disposed on the diaphragm 10, and the voice coil 20 is electrically connected to a metallic surface 11 of the diaphragm 10. Two circuit lines 15 are attached to the edge of the diaphragm 10 and are electrically connected to the metallic surface 11. However, two ends 25 of the voice coil 20 are connected to the metallic surface 11 at the periphery of the voice coil 20. Since stiffness of connection points of the two ends 25 of the voice coil 20 is obviously different to that of the diaphragm 10, and the part of the diaphragm 10 at the periphery of the voice coil 20 is a main vibration area, which is required to be soft and have similar Young's modulus in order to vibrate in large amplitude and in consistency for providing a low frequency sound. However, the connection points of the two ends 25 of the voice coil 20 obviously spoil vibration consistency of such area, such that the distortion is increased and the sound quality if deteriorated.

SUMMARY

Accordingly, the invention is directed to a vibrating element, by which a problem that a voice coil influences vibration of a diaphragm is resolved.

The invention provides a vibrating element including a diaphragm, a voice coil and a stiffening layer. The diaphragm has a first surface and a second surface opposite to each other, where the first surface includes a first conductive region and a second conductive region separated from each other. The voice coil is disposed on the first surface of the diaphragm, where two ends of the voice coil are electrically connected to the first conductive region and the second conductive region, respectively. The stiffening layer is disposed on the diaphragm. The diaphragm has a center region, which is enclosed and circled by the voice coil and includes an area of the diaphragm above the voice coil. The region outside the center region includes an inner circled zone and an outer circled zone surrounding the inner circled zone. At least one end of the voice coil is located in the inner circled zone and the stiffening layer covers the inner circled zone.

In an embodiment of the invention, the stiffening layer has a ring shape.

In an embodiment of the invention, the stiffening layer has a round shape, and the stiffening layer covers the center region.

In an embodiment of the invention, when the stiffening layer is disposed on the second surface, the stiffening layer is a rigid film or a stiffening adhesive.

In an embodiment of the invention, when the stiffening layer is disposed on the first surface, the stiffening layer is a non-conductive insulation coating with high stiffness.

In an embodiment of the invention, the first conductive region is configured with a first conductive layer, and the second conductive region is configured with a second conductive layer.

In an embodiment of the invention, the two ends of the voice coil are respectively electrically connected to the first conductive region and the second conductive region through a conductive adhesive.

In an embodiment of the invention, the vibrating element further includes a frame, a first terminal and a second terminal. The frame has a first side and a second side opposite to each other, where the diaphragm is disposed at the first side of the frame. The first terminal is disposed between the first side of the frame and the diaphragm, and is electrically connected to the first conductive region. The second terminal is disposed between the first side of the frame and the diaphragm, and is electrically connected to the second conductive region.

In an embodiment of the invention, the two ends of the voice coil are both located in the inner circled zone.

In an embodiment of the invention, one end of the voice coil is located in the inner circled zone, and the other end is located in the center region.

In an embodiment of the invention, the first terminal and the second terminal are circuit lines on a flexible circuit board, and one ends of the first terminal and the second terminal are folded to the second side of the frame along with folding of the flexible circuit board.

In an embodiment of the invention, the first terminal and the second terminal are partially embedded in the frame, and one ends of the first terminal and the second terminal penetrate through the frame and are exposed at the second side of the frame.

In an embodiment of the invention, the frame, the first terminal and the second terminal are formed through insert-injection molding.

In an embodiment of the invention, the frame further has a plurality of through holes.

In an embodiment of the invention, the first terminal and the second terminal respectively contact in surface the first conductive region and the second conductive region.

According to the above descriptions, in the invention, by configuring the stiffening layer of the vibrating element, the influence of the voice coil and the two ends thereof on sound quality presented when the diaphragm vibrates is decreased, such that the sound quality of the vibrating element has a better performance.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
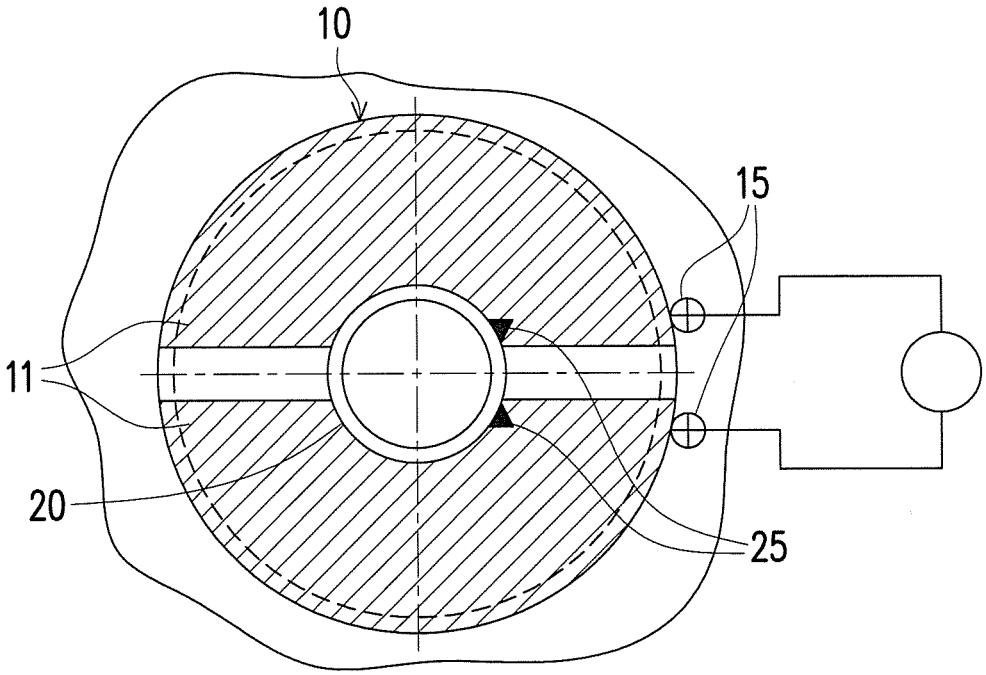
FIG. 1 is a schematic diagram of a conventional vibrating element.
Figure 2A:
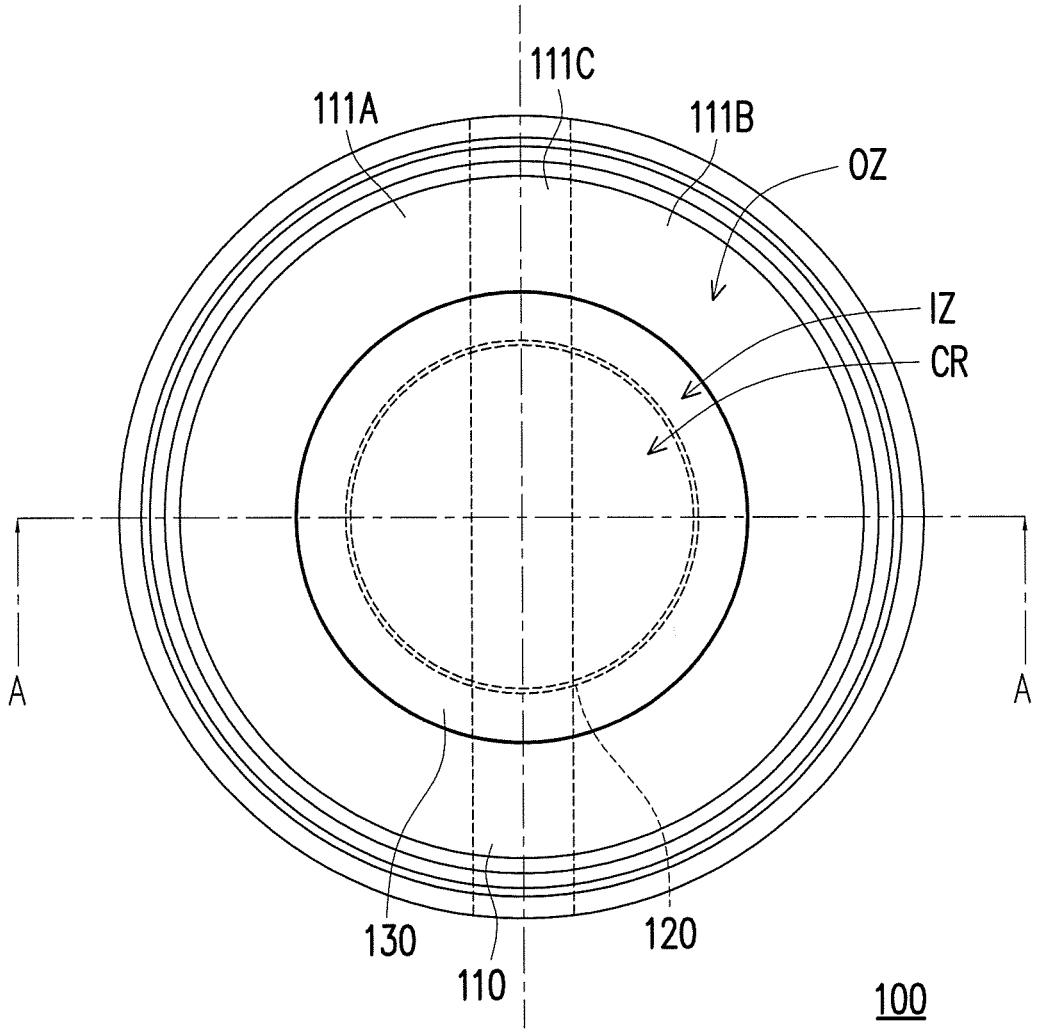
FIG. 2A is a front view of a vibrating element according to an embodiment of the invention.
Figure 2B:
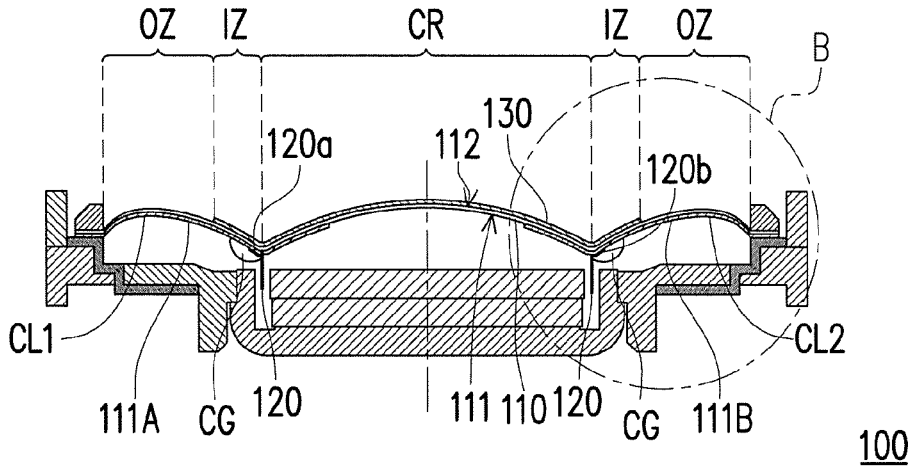
FIG. 2B is a cross-sectional view of the vibrating element of FIG. 2A along a section line A-A.
Figure 2C:
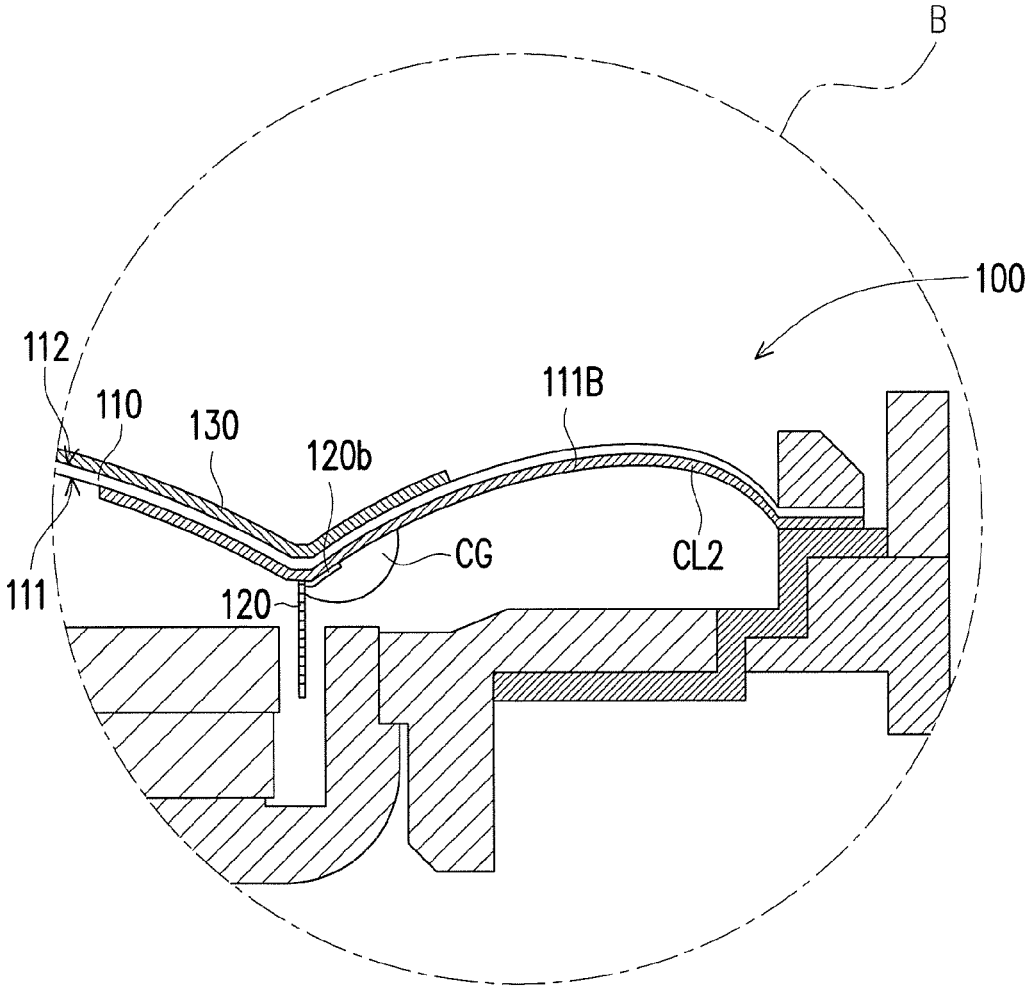
FIG. 2C is an enlarged view of a partial area B of FIG. 2B.

FIG. 2A is a front view of a vibrating element according to an embodiment of the invention. FIG. 2B is a cross-sectional view of the vibrating element of FIG. 2A along a section line A-A. FIG. 2C is an enlarged view of a partial area B of FIG. 2B. Referring to FIG. 2A, FIG. 2B and FIG. 2C, the vibrating element 100 of the invention includes a diaphragm 110, a voice coil 120 and a stiffening layer 130. For example, in the present embodiment, the diaphragm 110 has a first surface 111 and a second surface 112 opposite to each other, where the first surface 111 includes a first conductive region 111A and a second conductive region 111B separated from each other. In detail, in the present embodiment, the first conductive region 111A and the second conductive region 111B are separated by a linear non-conductive region 111C, and the first conductive region 111A and the second conductive region 111B respectively present a shape similar to a semicircle, though the invention is not limited thereto. In other embodiments, the first conductive region 111A and the second conductive region 111B can be only located outside the voice coil 120, and respectively present a shape similar to a semicircular ring. Those skilled in the art may design the shape of the first surface 111, the first conductive region 111A or the second conductive region 111B according to an actual requirement, and details thereof is not repeated.

Moreover, in the present embodiment, the first conductive region 111A is configured with a first conductive layer CL1, and the second conductive region 111B is configured with a second conductive layer CL2. The first conductive layer CL1 and the second conductive layer CL2 are, for example, formed on the diaphragm 110 through evaporation, sputtering, electroplating, coating of conductive paint, etc., though the invention is not limited thereto. In another embodiment, the first conductive region 111A and the second conductive region 111B can be entirely formed by a conductive material, and those skilled in the art can choose the method for forming the first conductive region 111A and the second conductive region 111B according to an actual requirement, which is not repeated.

On the other hand, in the present embodiment, the voice coil 120 is disposed on the first surface 111 of the diaphragm 110, where two ends 120*a* and 120*b* of the voice coil 120 are electrically connected to the first conductive region 111A and the second conductive region 111B, respectively. In the present embodiment, the voice coil 120 is, for example, formed by winding a thin metal wire by multiple turns to form a hollow column shape, and the two ends 120*a* and 120*b* of the voice coil 120 is defined as two tail ends of the thin metal wire. Moreover, the two ends 120*a* and 120*b* of the voice coil 120 are, for example, electrically connected to the first conductive region 111A and the second conductive region 111B through a conductive adhesive CG (for example, silver paste), though the invention is not limited thereto. In other embodiments, the two ends 120*a* and 120*b* of the voice coil 120 can also be electrically connected to the first conductive region 111A and the second conductive region 111B through laser welding.

In detail, as shown in FIG. 2A and FIG. 2C, in the present embodiment, the diaphragm 110 has an enclosed area, which is defined as a center region CR, and the center region CR includes an area of the diaphragm 110 right above the voice coil 120, which is enclosed and circled by the voice coil 120. In other words, the center region CR also includes an inner closed zone surrounded by a main body of the voice coil 120. The region outside the center region CR includes an inner circled zone IZ and an outer circled zone OZ surrounding the inner circled zone IZ. Further, at least one of the two ends 120*a* and 120*b* of the voice coil 120 is located in the inner circled zone IZ. For example, in the present embodiment, the two ends 120*a* and 120*b* of the voice coil 120 extend to the inner circled zone IZ surrounding the center region CR, and do not fall in the outer circled zone OZ. In other words, in the present embodiment, the region that is not connected to the two ends 120*a* and 120*b* of the voice coil 120 is defined as the outer circled zone OZ, which has higher and consistent flexibility.

When an area of the center region CR is decreased along with a design requirement, the two ends 120*a* and 120*b* of the voice coil 120 that are disposed in the inner circled zone IZ surrounding the center region CR avails decreasing an implementation difficulty for electrically connecting the two ends 120*a* and 120*b* of the voice coil 120 with the first conductive region 111A and the second conductive region 111B. Conversely, if the two ends 120*a* and 120*b* of the voice coil 120 are disposed in the center region CR, when the area of the center region CR is decreased along with the design requirement, implementation difficulty for electrically connecting the two ends 120*a* and 120*b* of the voice coil 120 with the first conductive region 111A and the second conductive region 111B is very high. Based on the above reason, the two ends 120*a* and 120*b* of the voice coil 120 can be all disposed in the inner circled zone IZ outside the center region CR.

On the other hand, in the present embodiment, the stiffening layer 130 is disposed on the second surface 112 of the diaphragm 110. For example, the stiffening layer 130 has a round shape, and stiffness of the stiffening layer 130 is higher than stiffness of the diaphragm 110, such that a vibration amplitude of the region of the diaphragm 110 that is covered by the stiffening layer 130 is smaller than that of the region of the diaphragm 110 that is not covered by the stiffening layer 130. In detail, in the present embodiment, the stiffening layer 130 is a rigid film with high stiffness, and a material thereof can be beryllium, aluminium, liquid crystal polymer (LCP), aerogel or other materials suitable to serve as the rigid film with high stiffness, though the invention is not limited thereto. In other embodiments, the stiffening layer 130 can also be formed on the diaphragm 110 through evaporation or deposition according to an actual process requirement, and in these embodiments, the stiffening layer 130 can be rigid film with high stiffness such as evaporation metal or deposition diamond-like carbon film, etc.

Further, referring to FIG. 2C, the stiffening layer 130 covers the inner circled zone IZ and the center region CR, and the two ends 120*a* and 120*b* of the voice coil 120 are located in the inner circled zone IZ. Therefore, when the diaphragm 110 vibrates, only the outer circled zone OZ that is not covered by the stiffening layer 130 has a larger vibration amplitude, and the vibration amplitude of the inner circled zone IZ where the two ends 120*a* and 120*b* of the voice coil 120 are located is relatively small. In this way, when the vibrating element 100 provides a low frequency sound, the diaphragm 110 may have a large amplitude vibration through the flexible outer circled zone OZ, and the vibration amplitude of the inner circled zone IZ where the two ends 120*a* and 120*b* of the voice coil 120 are located is suppressed through the stiffening layer 130. Therefore, the vibrating element 100 can keep vibration consistency of the outer circled zone OZ to greatly reduce the influence of the two ends 120*a* and 120*b* of the voice coil 120 on sound quality presented when the diaphragm 110 vibrates, so that the sound performance of the vibrating element 100 is improved.

Figure 3A:
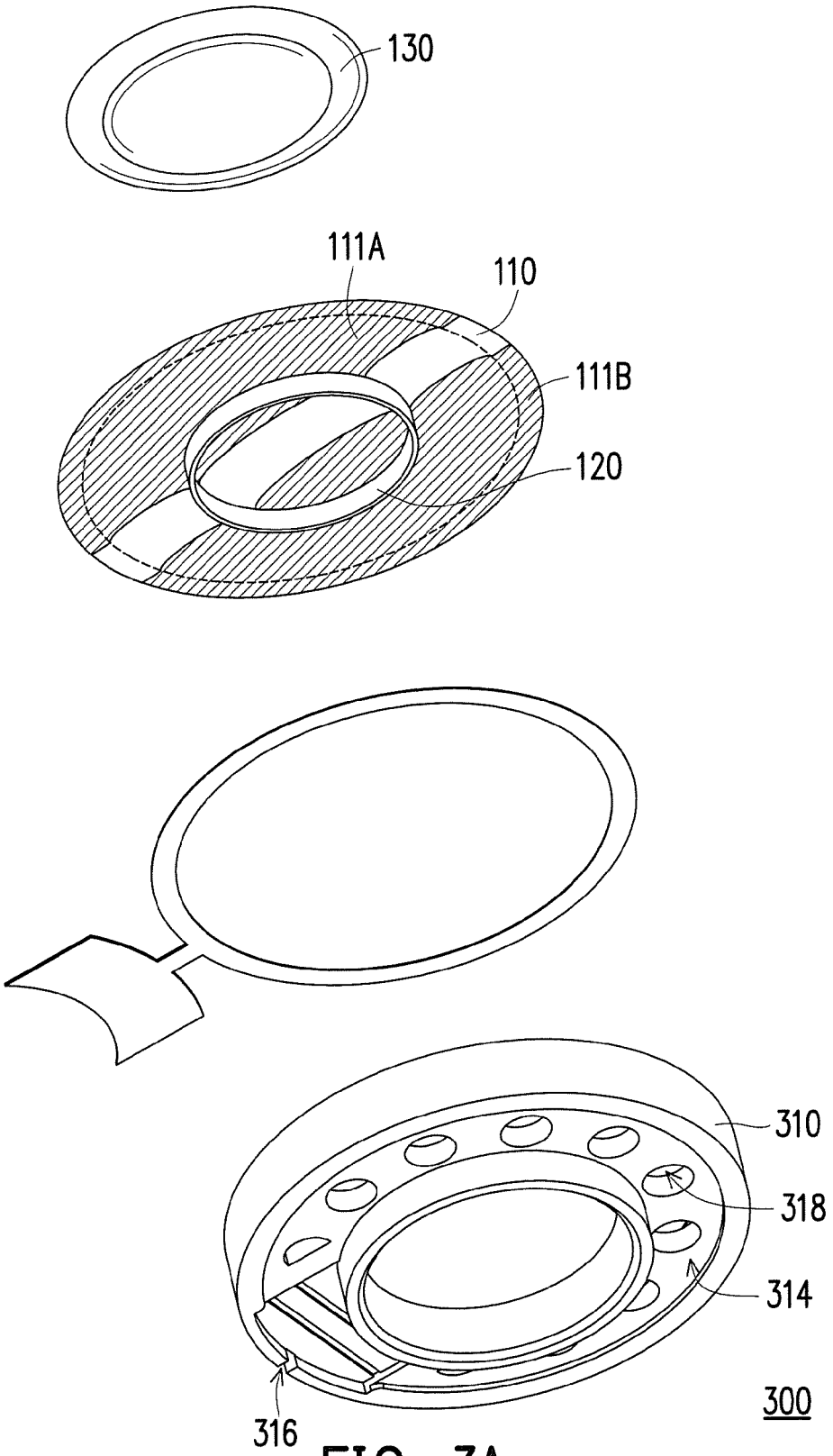
FIG. 3A and FIG. 3B are exploded views of a vibrating element of two viewing angles according to another embodiment of the invention.
Figure 3B:
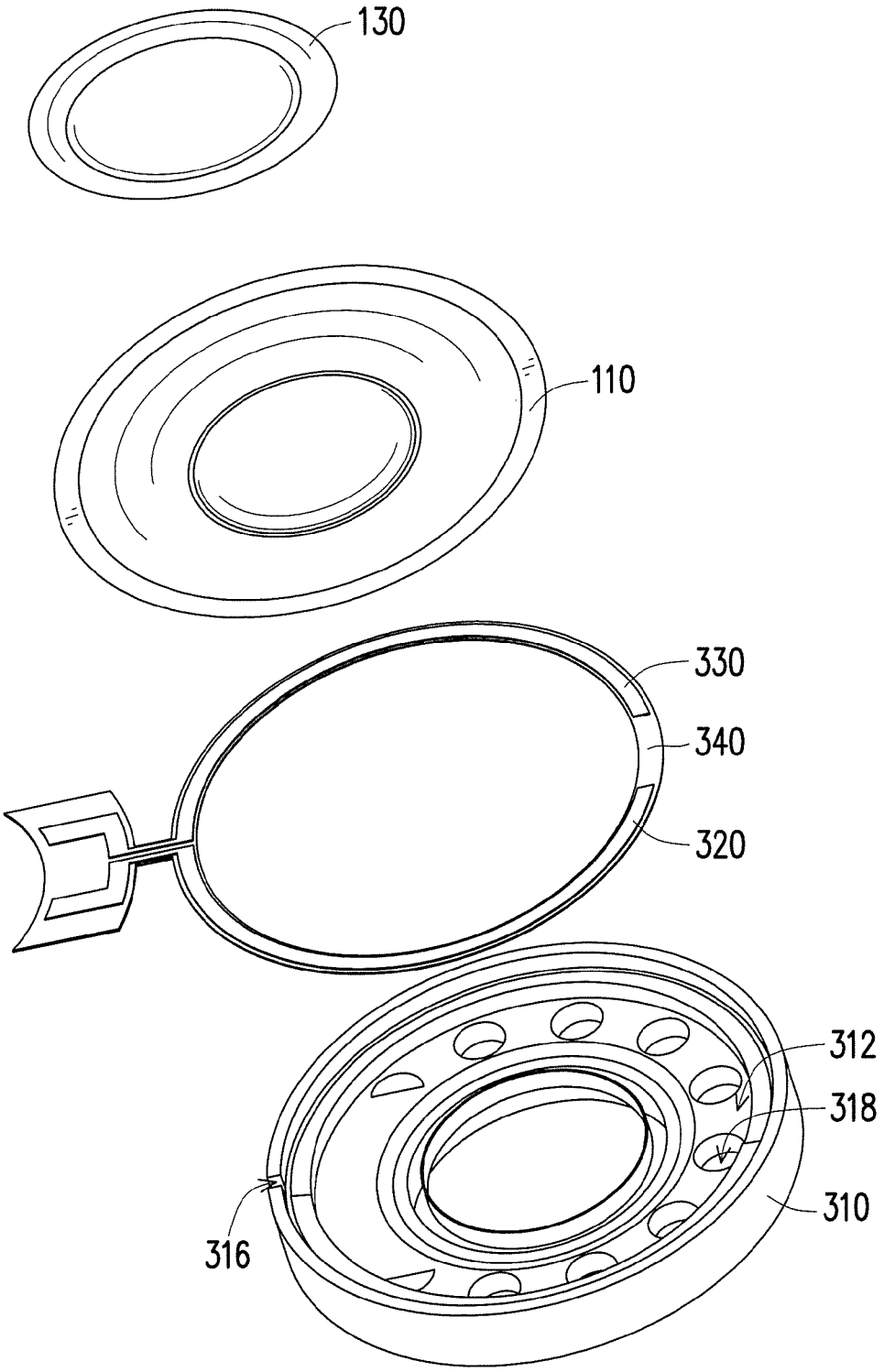

FIG. 3A and FIG. 3B are exploded views of a vibrating element of two viewing angles according to another embodiment of the invention. Referring to FIG. 3A and FIG. 3B, besides the diaphragm 110, the voice coil 120 and the stiffening layer 130 shown in FIG. 2A, the vibrating element 300 of the present embodiment further includes a frame 310, a first terminal 320 and a second terminal 330. The frame 310 has a first side 312 and a second side 314 opposite to each other. The diaphragm 110 is disposed at the first side 312 of the frame 310. The first terminal 320 is disposed between the first side 312 of the frame 310 and the diaphragm 110, and is electrically connected to the first conductive region 111A. The second terminal 330 is disposed between the first side 312 of the frame 310 and the diaphragm 110, and is electrically connected to the second conductive region 111B.

The frame 310 is used for supporting the diaphragm 110, and external sound signals can be transmitted into or out of the voice coil 120 through a conductive path formed by the first terminal 320, the second terminal 320, the first conductive region 111A and the second conductive region 111B. In the present embodiment, the first terminal 320 contact in surface the first conductive region 111A, and the second terminal 330 contact in surface the second conductive region 111B. Therefore, in the present embodiment, by designing the first conductive region 111A and the second conductive region 111B disposed on the diaphragm 110, the subsequent assembling process can be easier.

The first terminal 320 and the second terminal 330 of the present embodiment are circuit lines on a flexible circuit board 340. Therefore, one ends of the first terminal 320 and the second terminal 330 that are not contacting the first conductive region 111A and the second conductive region 111B can be folded to the second side 314 of the frame 310 long with folding of the flexible circuit board 340. Then, the ends of the first terminal 320 and the second terminal 330 located at the second side 314 of the frame 310 are connected to an external sound source. In the present embodiment, the side edge of the frame 310 has a notch 316 for the flexible circuit board 340 to be folded and pass through. Moreover, the frame 310 can be designed to have a plurality of through holes 318, and gas can passes there through when the diaphragm 110 vibrates.

Figure 4A:
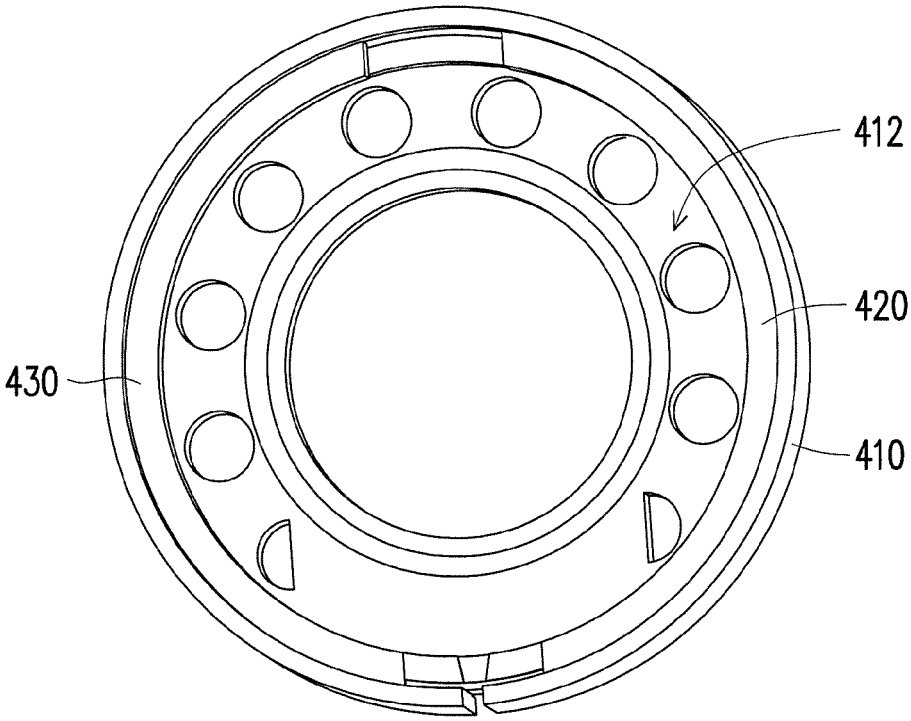
FIG. 4A and FIG. 4B are exploded views of a vibrating element of two viewing angles according to still another embodiment of the invention.
Figure 4B:
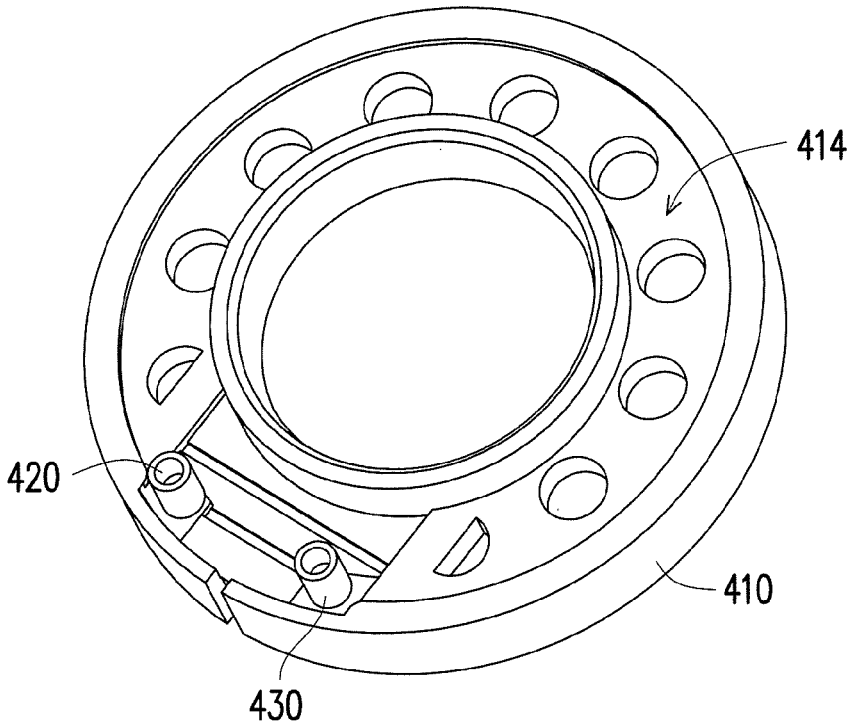

FIG. 4A and FIG. 4B are exploded views of a vibrating element of two viewing angles according to another embodiment of the invention. The vibrating element of the present embodiment also applies the diaphragm 110, the voice coil 120 and the stiffening layer 130 shown in FIG. 2A, though in the present embodiment, the first terminal 420 and the second terminal 430 are partially embedded in the frame 410, and one ends of the first terminal 420 and the second terminal 430 penetrate through the frame 410 and are exposed at the second side 414 of the frame 410. Therefore, the part of the first terminal 420 and the second terminal 430 located at the first side 412 of the frame 410 can be electrically connected to the first conductive region 111A and the second conductive region 111B (shown in FIG. 2A), and one ends of the first terminal 420 and the second terminal 430 exposed at the second side 414 of the frame 410 can be electrically connected to an external sound source. The first terminal 420 and the second terminal 430 of the present embodiment are, for example, made of metal, and the first terminal 420 and the second terminal 430 are embedded in the frame 410 when they are formed on the frame 410 through an insert-injection molding technique.

Moreover, in the aforementioned embodiment, although the shape of the stiffening layer 130 is a round shape, the invention is not limited thereto. Possible variations of the shape of the stiffening layer 130 are described below with reference of FIG. 5 to FIG. 6B.

Figure 5:
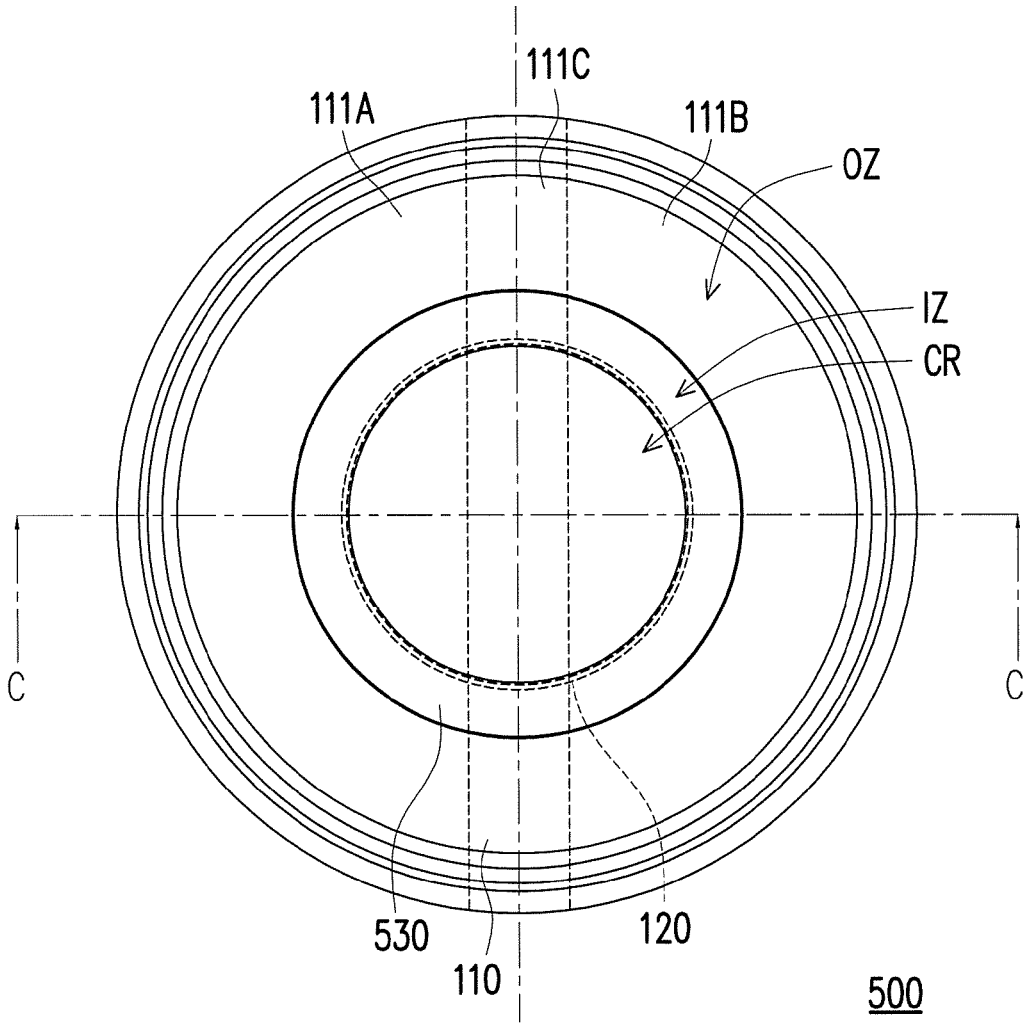
FIG. 5 is a front view of a vibrating element according to another embodiment of the invention.
Figure 6A:
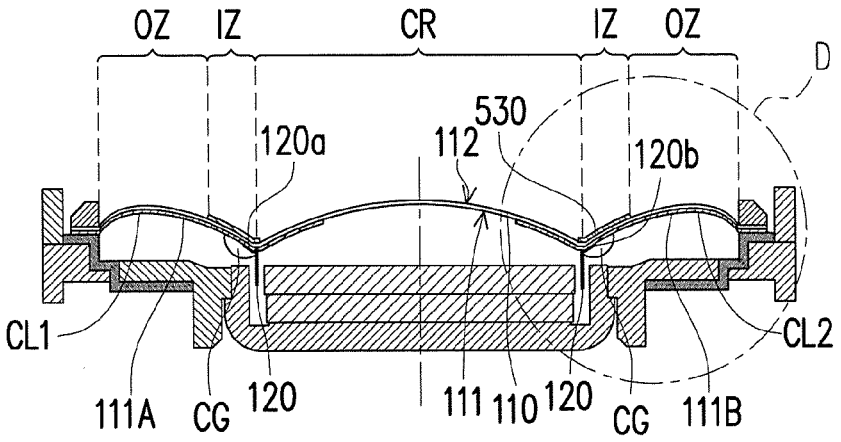
FIG. 6A is a cross-sectional view of the vibrating element of FIG. 5 along a section line C-C.
Figure 6B:
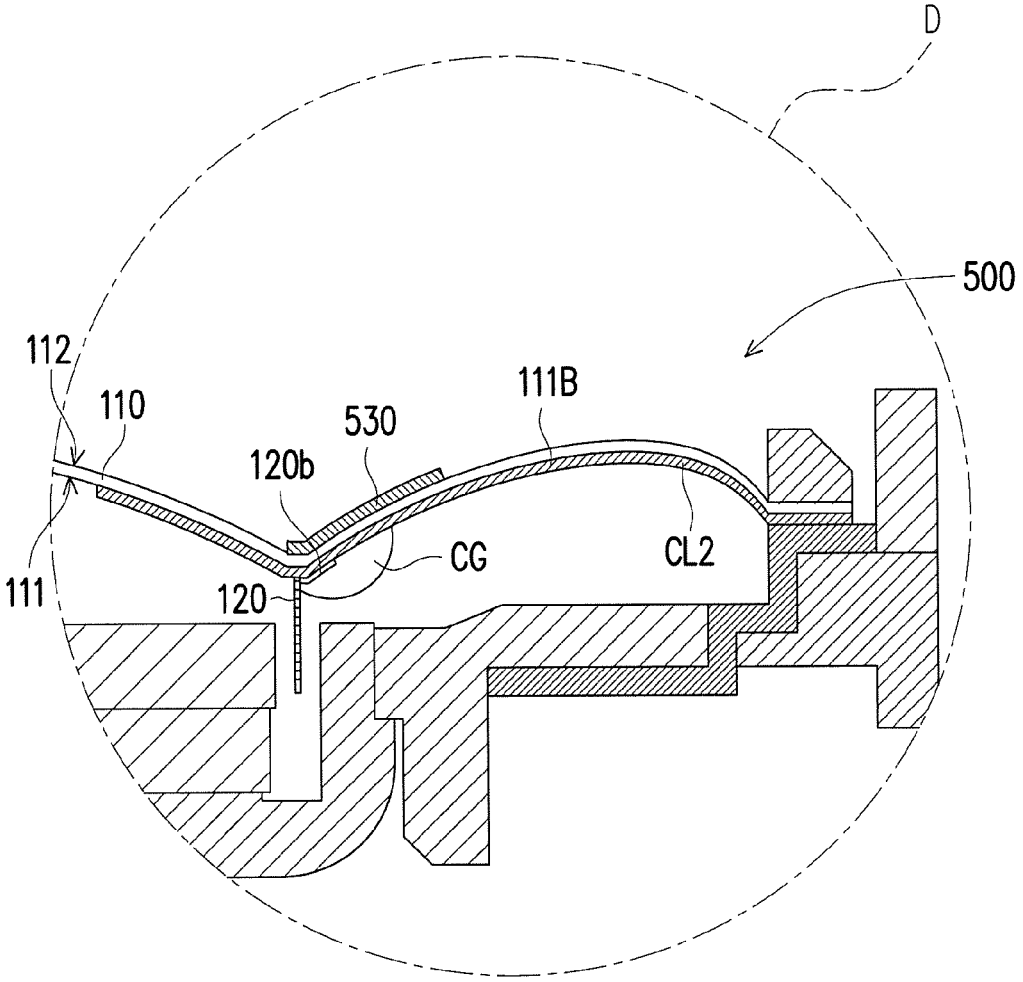
FIG. 6B is an enlarged view of a partial region D of FIG. 6A.

FIG. 5 is a front view of a vibrating element according to another embodiment of the invention. FIG. 6A is a cross-sectional view of the vibrating element of FIG. 5 along a section line C-C. FIG. 6B is an enlarged view of a partial region D of FIG. 6A. Referring to FIG. 5 to FIG. 6B, in the present embodiment, the vibrating element 500 of FIG. 5 is similar to the vibrating element 100 of FIG. 2A, and differences there between are as follows. As shown in FIG. 5, in the present embodiment, the shape of the stiffening layer 530 is a ring-shape. Since the stiffening layer 530 also covers the inner circled zone IZ where the two ends 120*a* and 120*b* of the voice coil 120 are located, the influence of the voice coil 120 and the two ends 120*a* and 120*b* thereof on the sound quality presented when the diaphragm 110 vibrates is greatly decreased, and the vibrating element 500 has a good sound performance. Therefore, the vibrating element 500 also has the same advantages mentioned in description of the vibrating element 100, and details thereof are not repeated.

Figure 7:
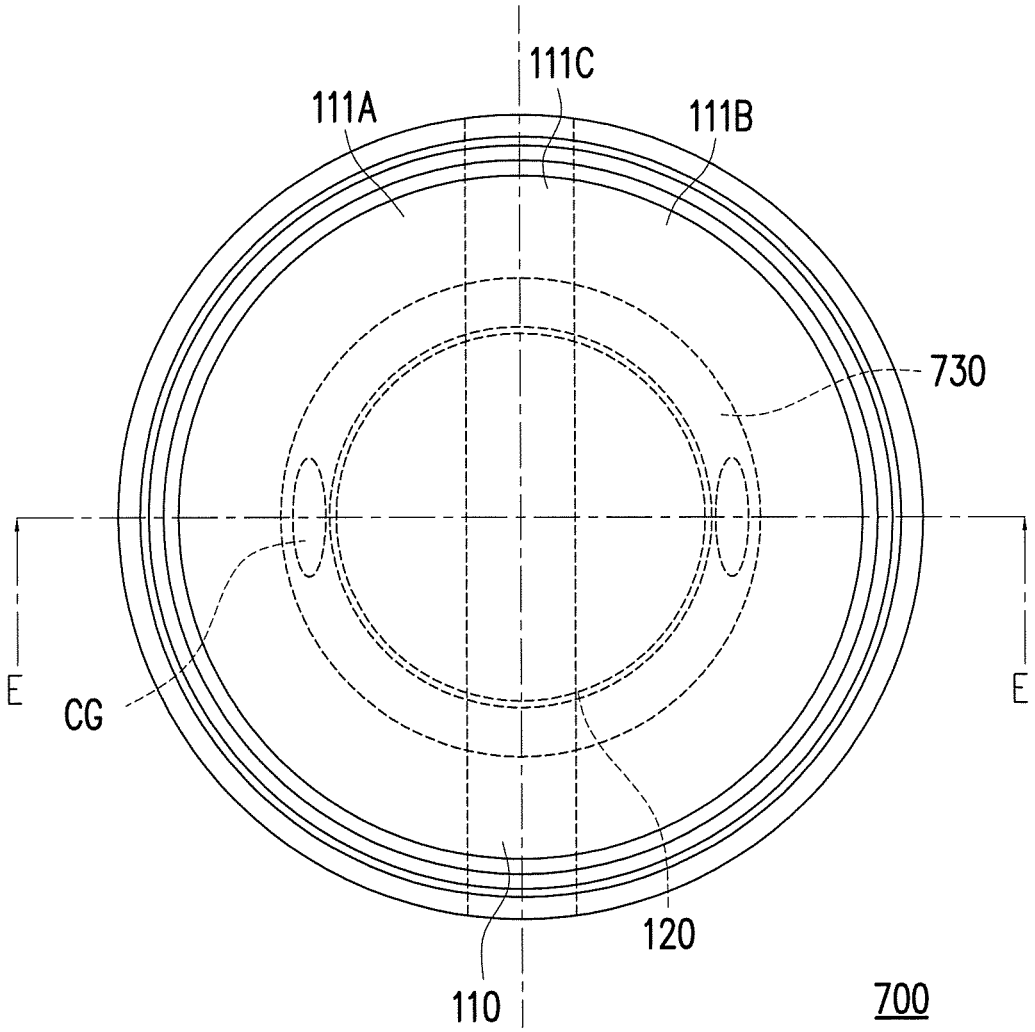
FIG. 7 is a front view of a vibrating element according to another embodiment of the invention.
Figure 8A:
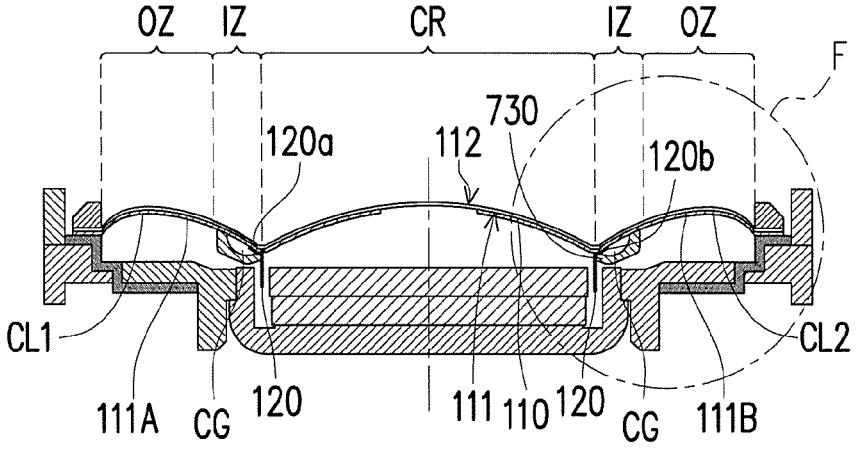
FIG. 8A is a cross-sectional view of the vibrating element of FIG. 7 along a section line E-E.
Figure 8B:
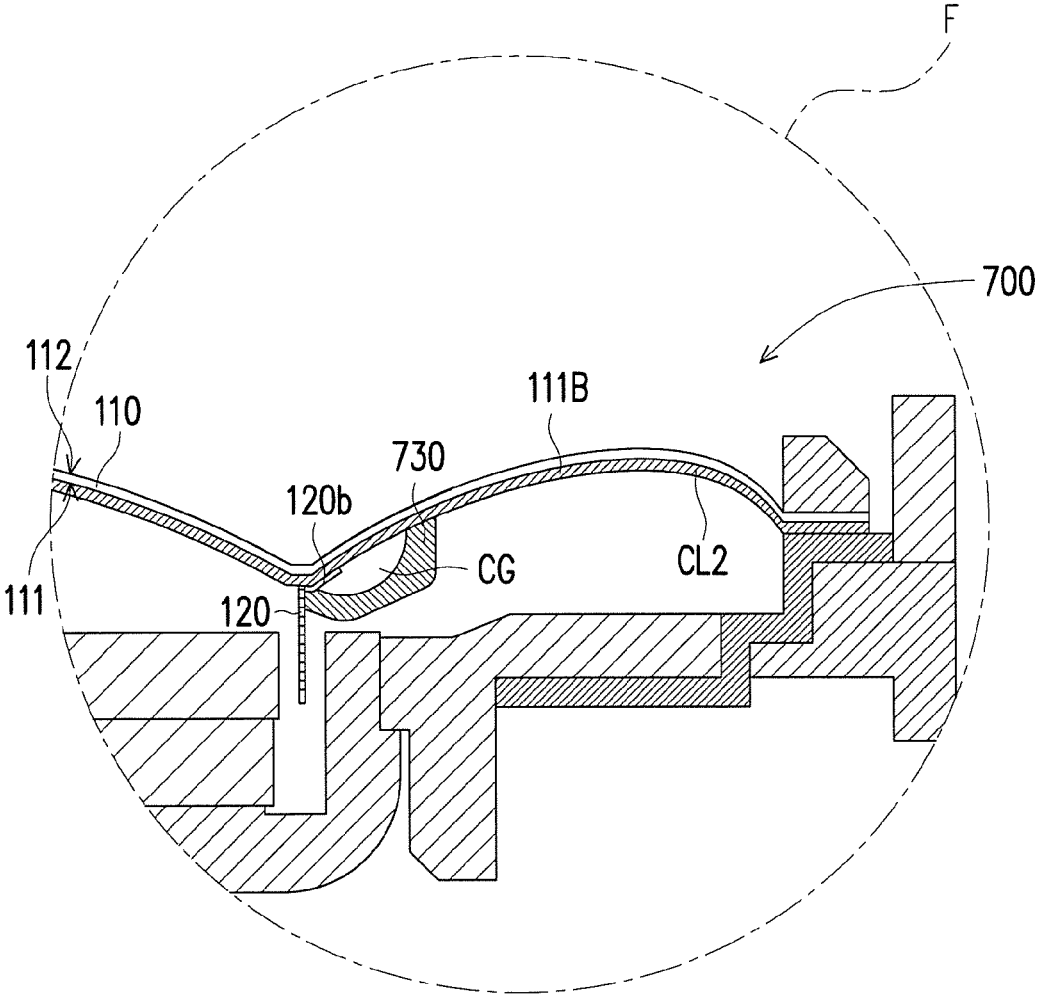
FIG. 8B is an enlarged view of a partial region F of FIG. 8A.

FIG. 7 is a front view of a vibrating element according to another embodiment of the invention. FIG. 8A is a cross-sectional view of the vibrating element of FIG. 7 along a section line E-E. FIG. 8B is an enlarged view of a partial region F of FIG. 8A. Referring to FIG. 7 to FIG. 8B, in the present embodiment, the vibrating element 700 of FIG. 7 is similar to the vibrating element 100 of FIG. 2A, and differences there between are as follows. As shown in FIG. 7, the shape of the stiffening layer 730 viewing from the top view is a ring-shape. As shown in FIG. 8A and FIG. 8B, in the present embodiment, the stiffening layer 730 is located on the first surface 111, and wraps the conductive adhesive CG covering the two ends 120*a* and 120*b* of the voice coil 120. In detail, the material of the stiffening layer 730 can be a non-conductive insulation coating with high stiffness, for example, epoxy or other stiffening adhesive.

In the present embodiment, since the stiffening layer 730 also covers the inner circled zone IZ where the two ends 120*a* and 120*b* of the voice coil 120 are located, the influence of the voice coil 120 and the two ends 120*a* and 120*b* thereof on the sound quality presented when the diaphragm 110 vibrates is greatly decreased, and the vibrating element 700 has a good sound performance. Therefore, the vibrating element 700 also has the same advantages mentioned in description of the vibrating element 100, and details thereof are not repeated.

Moreover, in other embodiments, the vibrating elements 500 and 700 may also include components such as the frames 310, 410, the first terminals 420, 420 and the second terminals 330, 430, etc., to from a structure design similar to that of the vibrating element of FIG. 3A to FIG. 4B, which also has the same advantages mentioned in description of the aforementioned vibrating element, and details thereof are not repeated.

Figure 9A:
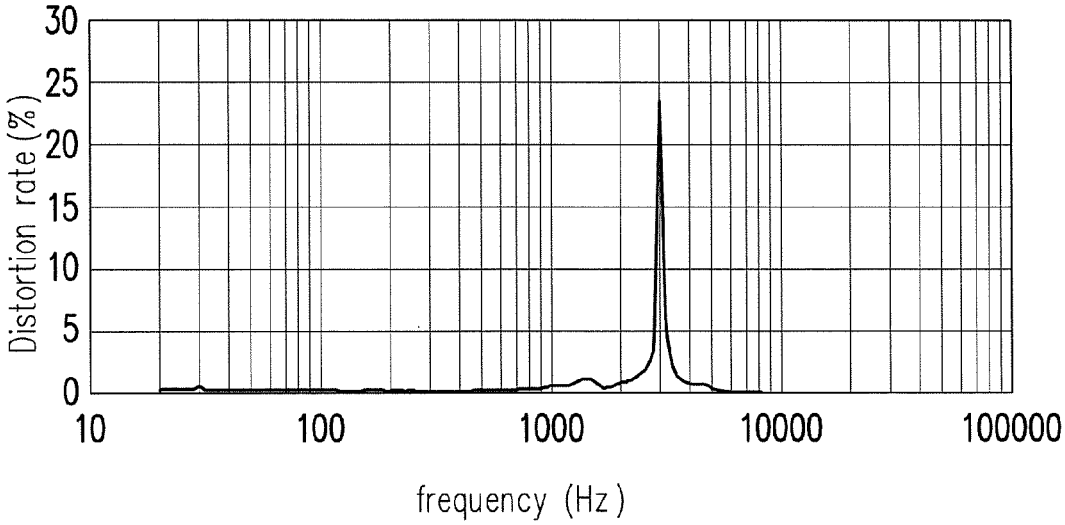
FIG. 9A is a frequency-distortion rate curve diagram of the vibrating element of FIG. 8A without configuring the stiffening layer.
Figure 9B:
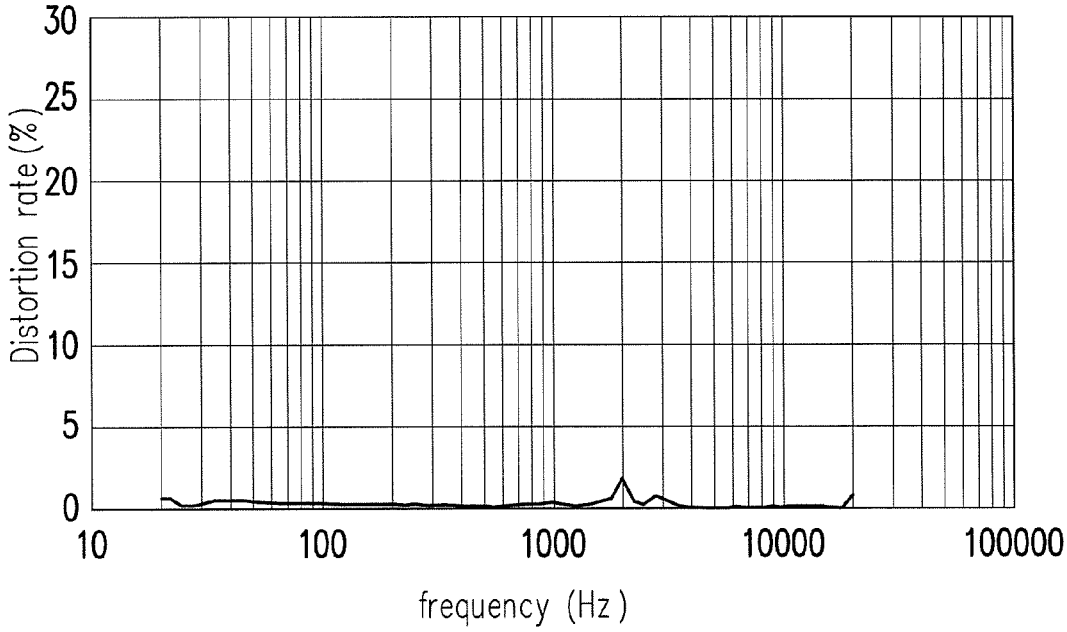
FIG. 9B is a frequency-distortion rate curve diagram of the vibrating element of FIG. 8A configured with the stiffening layer.

FIG. 9A is a frequency-distortion rate curve diagram of the vibrating element of FIG. 8A without configuring the stiffening layer, and FIG. 9B is a frequency-distortion rate curve diagram of the vibrating element of FIG. 8A configured with the stiffening layer. According to FIG. 9A, it is known that if the vibrating element is configured without the stiffening layer, distortion rates of a part of frequencies are very high, so that the sound performance is poor. However, according to FIG. 9B, it is known that when the vibrating element is configured with the stiffening layer, the distortion rates of the part of frequencies originally having high distortion rates are greatly decreased, so that the sound performance is enhanced.

Moreover, in the aforementioned embodiment, although a situation that the two ends 120*a* and 120*b* of the voice coil 120 are all located in the inner circled zone IZ is taken as an example for description, the invention is not limited thereto, and possible variation of allocation positions of the two ends 120*a* and 120*b* of the voice coil 120 is described below with reference of FIG. 10 to FIG. 13B.

Figure 10:
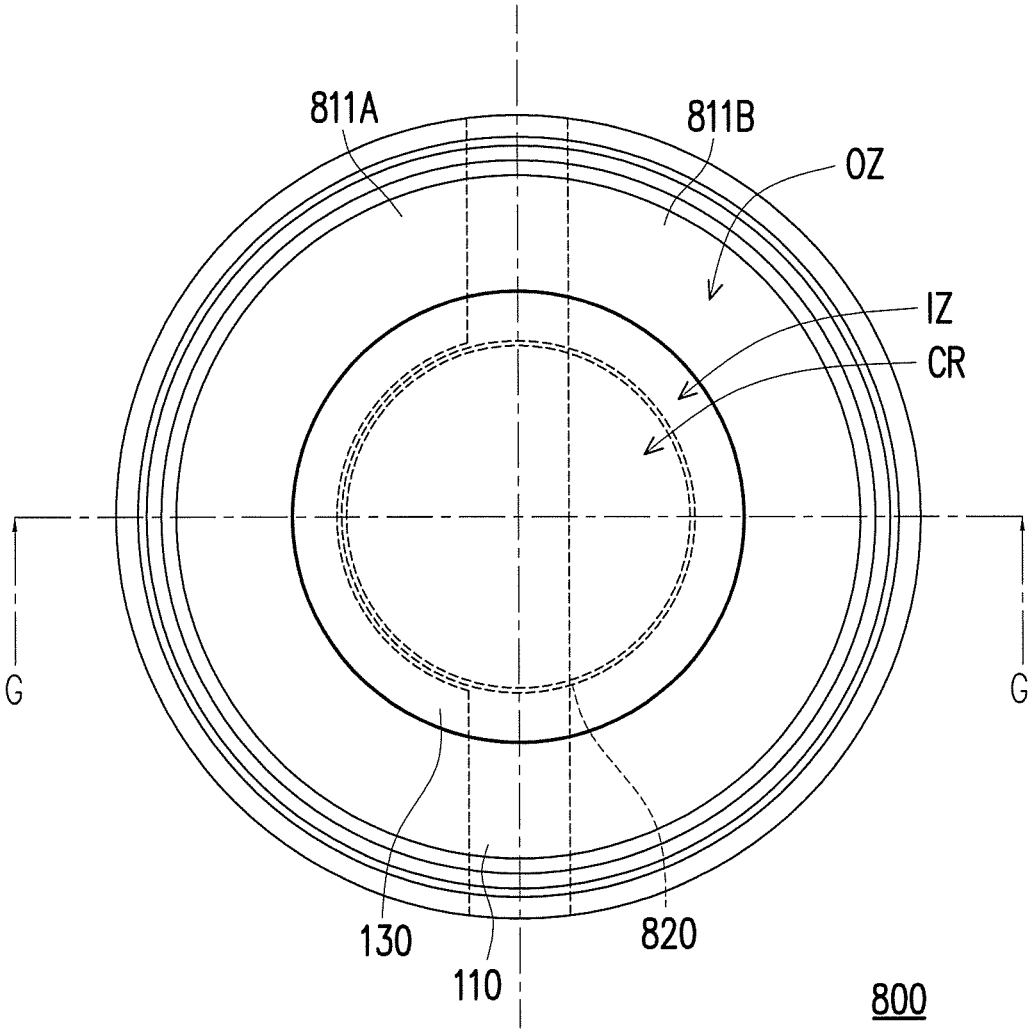
FIG. 10 is a front view of a vibrating element according to still another embodiment of the invention.
Figure 11A:
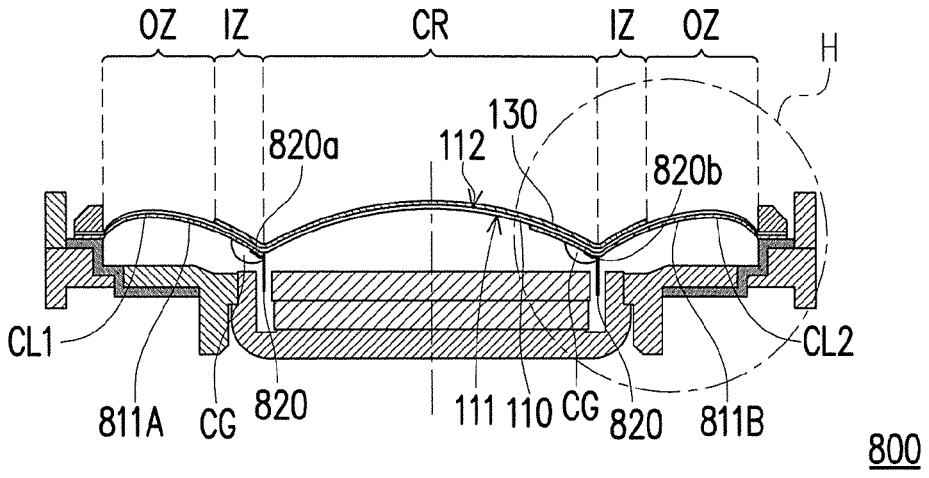
FIG. 11A is a cross-sectional view of the vibrating element of FIG. 10 along a section line G-G.
Figure 11B:
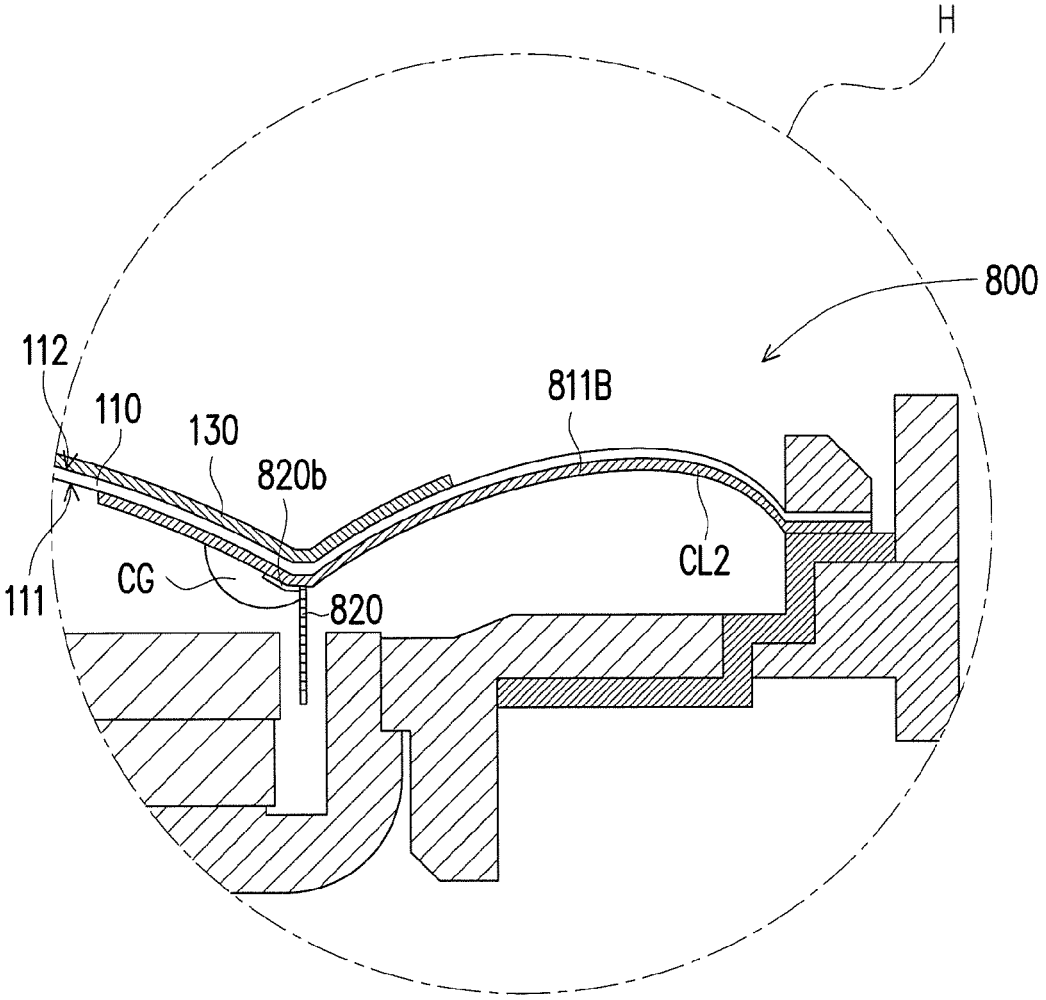
FIG. 11B is an enlarged view of a partial area H of FIG. 11A.

FIG. 10 is a front view of a vibrating element according to still another embodiment of the invention. FIG. 11A is a cross-sectional view of the vibrating element of FIG. 10 along a section line G-G. FIG. 11B is an enlarged view of a partial area H of FIG. 11A. Referring to FIG. 10 to FIG. 11B, in the present embodiment, the vibrating element 800 of FIG. 10 is similar to the vibrating element 100 of FIG. 2A, and a difference there between is as follows. As shown in FIG. 10, in the present embodiment, one end 820*a* of the voice coil 820 is located in the inner circled zone IZ, and the other end 820*b* is located in the center region CR. Moreover, the first conductive region 811A is located outside the voice coil 820, i.e. does not cover the center region CR and presents a shape similar to a semicircular ring. On the other hand, the second conductive region 811B covers a part of the center region CR, and is electrically connected to the end 820*b* of the voice coil 820 located in the center region CR, and presents a shape similar to a semicircle.

Moreover, as shown in FIG. 11A and FIG. 11B, since the stiffening layer 130 also covers the area where the two ends 820*a* and 820*b* of the voice coil 820 are located, the influence of the two ends 820*a* and 820*b* of the voice coil 820 on sound quality presented when the diaphragm 110 vibrates is greatly reduced, so that the sound performance of the vibrating element 800 is improved. Therefore, the vibrating element 800 also has the advantages mentioned in description of the vibrating element 100, which are not repeated.

Figure 12:
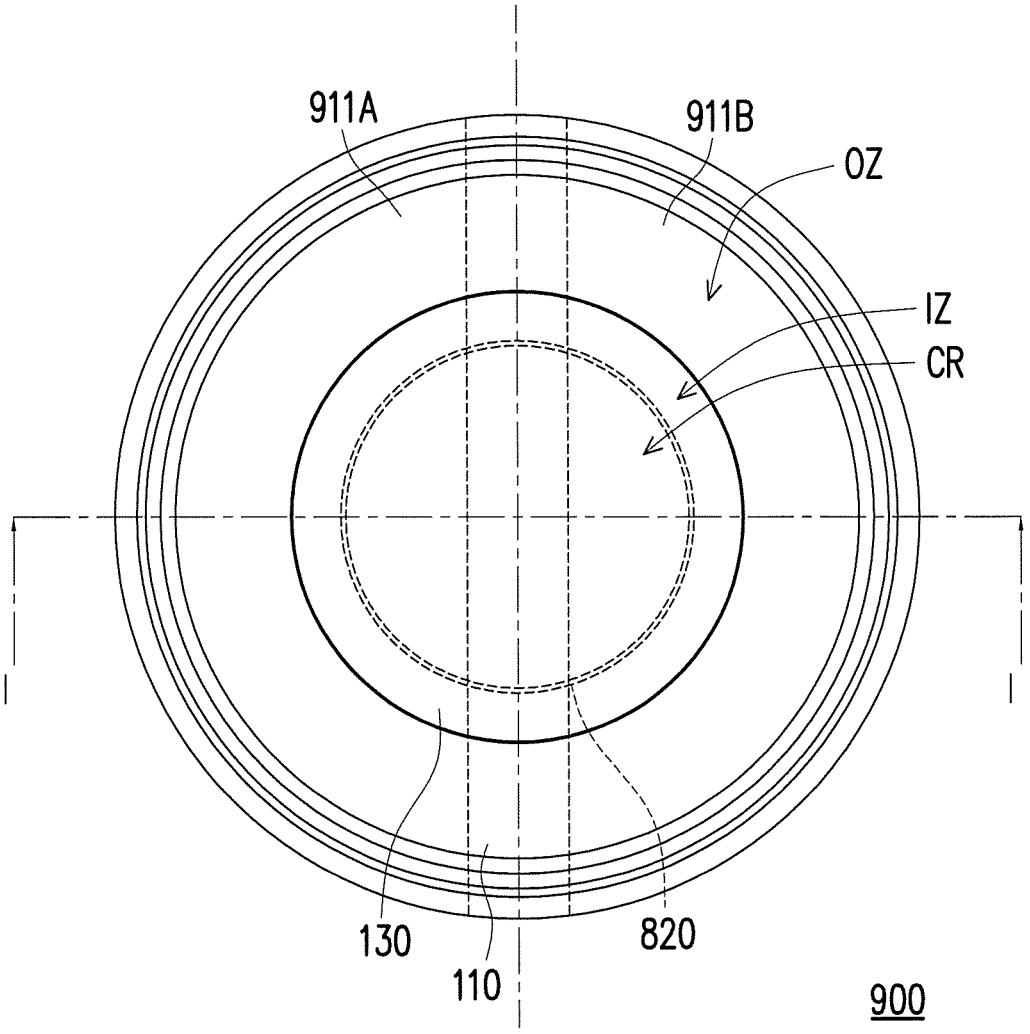
FIG. 12 is a front view of a vibrating element according to still another embodiment of the invention.
Figure 13A:
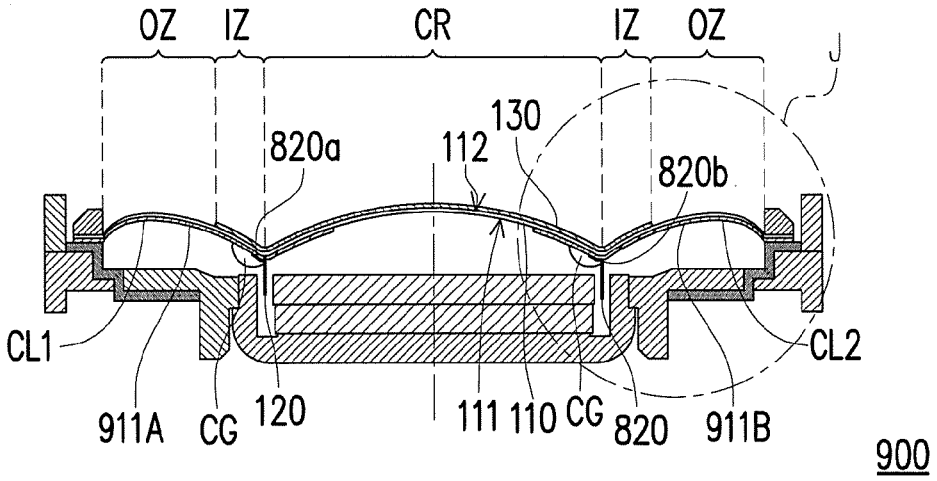
FIG. 13A is a cross-sectional view of the vibrating element of FIG. 12 along a section line I-I.
Figure 13B:
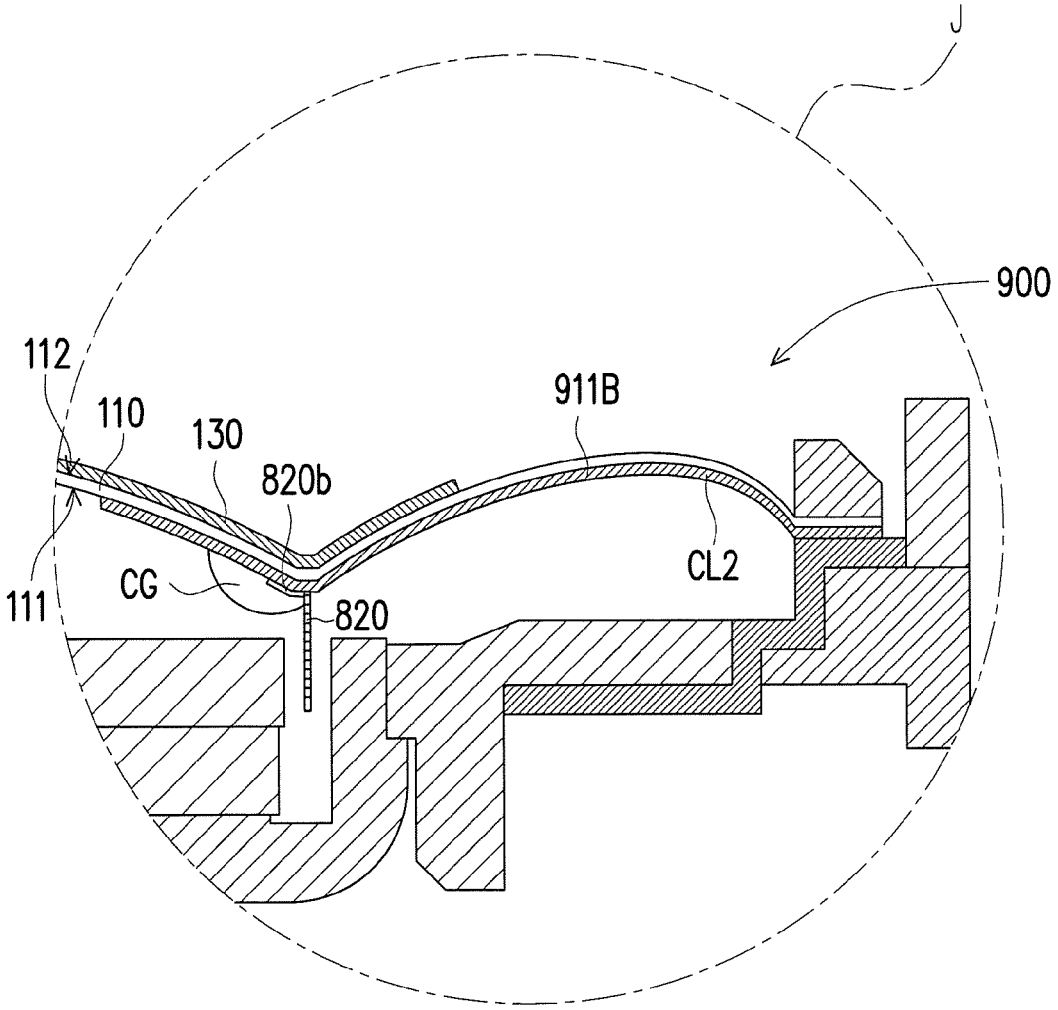
FIG. 13B is an enlarged view of a partial area J of FIG. 13A.

FIG. 12 is a front view of a vibrating element according to still another embodiment of the invention. FIG. 13A is a cross-sectional view of the vibrating element of FIG. 12 along a section line I-I. FIG. 13B is an enlarged view of a partial area J of FIG. 13A. Referring to FIG. 12 to FIG. 13B, in the present embodiment, the vibrating element 900 of FIG. 12 is similar to the vibrating element 800 of FIG. 10, and a difference there between is as follows. As shown in FIG. 12, in the present embodiment, the first conductive region 911A and the second conductive region 911B all cover a part of the center region CR, and respectively present a shape similar to a semicircle. Moreover, as shown in FIG. 13A and FIG. 13B, since the stiffening layer 830 also covers the area where the two ends 820*a* and 820*b* of the voice coil 820 are located, the influence of the two ends 820*a* and 820*b* of the voice coil 820 on sound quality presented when the diaphragm 110 vibrates is greatly reduced, so that the sound performance of the vibrating element 900 is improved. Therefore, the vibrating element 900 also has the advantages mentioned in description of the vibrating element 800, which are not repeated.

Moreover, in other embodiments, the vibrating elements 800 and 900 may also include the components such as the frames 310, 410, the first terminals 320, 420 and the second terminals 330, 430, etc. to implement the structure design similar to the vibrating elements shown in FIG. 3A to FIG. 4B, so that the vibrating elements 800 and 900 also have the advantages of the aforementioned vibrating elements, which are not repeated.

In summary, in the invention, by configuring the stiffening layer of the vibrating element, the influence of the voice coil and the two ends thereof on sound quality presented when the diaphragm vibrates is greatly decreased, such that the sound quality of the vibrating element has a better performance.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A vibrating element, comprising:

a diaphragm, having a first surface and a second surface opposite to each other, wherein the first surface comprises a first conductive region and a second conductive region separated from each other;

a voice coil, disposed on the first surface of the diaphragm, wherein two ends of the voice coil are electrically connected to the first conductive region and the second conductive region, respectively;

a stiffening layer, disposed on the diaphragm, wherein the diaphragm has a center region, the center region is enclosed and circled by the voice coil and comprises an area of the diaphragm above the voice coil, the region outside the center region comprises an inner circled zone and an outer circled zone surrounding the inner circled zone, at least one end of the voice coil is located in the inner circled zone, the stiffening layer covers the inner circled zone, and the stiffening layer has a ring shape.

2. The vibrating element as claimed in claim 1, wherein when the stiffening layer is disposed on the second surface, the stiffening layer is a rigid film or a stiffening adhesive.

3. The vibrating element as claimed in claim 1, wherein when the stiffening layer is disposed on the first surface, the stiffening layer is an insulation coating layer.

4. The vibrating element as claimed in claim 1, wherein the first conductive region is configured with a first conductive layer, and the second conductive region is configured with a second conductive layer.

5. The vibrating element as claimed in claim 1, wherein the two ends of the voice coil are both located in the inner circled zone.

6. The vibrating element as claimed in claim 1, wherein one end of the voice coil is located in the inner circled zone, and the other end is located in the center region.

7. The vibrating element as claimed in claim 1, further comprising:

a frame, having a first side and a second side opposite to each other, wherein the diaphragm is disposed at the first side of the frame;

a first terminal, disposed between the first side of the frame and the diaphragm, and electrically connected to the first conductive region; and a second terminal, disposed between the first side of the frame and the diaphragm, and electrically connected to the second conductive region.

8. The vibrating element as claimed in claim 7, wherein the first terminal and the second terminal are circuit lines on a flexible circuit board, and one ends of the first terminal and the second terminal are folded to the second side of the frame along with folding of the flexible circuit board.

9. The vibrating element as claimed in claim 7, wherein the first terminal and the second terminal are partially embedded in the frame, and one ends of the first terminal and the second terminal penetrate through the frame and are exposed at the second side of the frame.

10. The vibrating element as claimed in claim 9, wherein the frame, the first terminal and the second terminal are formed through insert-injection molding.

11. A vibrating element, comprising:

a diaphragm, having a first surface and a second surface opposite to each other, wherein the first surface comprises a first conductive region and a second conductive region separated from each other;

a voice coil, disposed on the first surface of the diaphragm, wherein two ends of the voice coil are electrically connected to the first conductive region and the second conductive region, respectively;

a stiffening layer, disposed on the diaphragm, wherein the diaphragm has a center region, the center region is enclosed and circled by the voice coil and comprises an area of the diaphragm above the voice coil, the region outside the center region comprises an inner circled zone and an outer circled zone surrounding the inner circled zone, at least one end of the voice coil is located in the inner circled zone, the stiffening layer covers the inner circled zone and the center region, and the stiffening layer has a round shape.

12. The vibrating element as claimed in claim 11, wherein when the stiffening layer is disposed on the second surface, the stiffening layer is a rigid film or a stiffening adhesive.

13. The vibrating element as claimed in claim 11, wherein when the stiffening layer is disposed on the first surface, the stiffening layer is an insulation coating layer.

14. The vibrating element as claimed in claim 11, wherein the first conductive region is configured with a first conductive layer, and the second conductive region is configured with a second conductive layer.

15. The vibrating element as claimed in claim 11, wherein the two ends of the voice coil are both located in the inner circled zone.

16. The vibrating element as claimed in claim 11, wherein one end of the voice coil is located in the inner circled zone, and the other end is located in the center region.

17. The vibrating element as claimed in claim 11, further comprising:

a frame, having a first side and a second side opposite to each other, wherein the diaphragm is disposed at the first side of the frame;

a first terminal, disposed between the first side of the frame and the diaphragm, and electrically connected to the first conductive region; and a second terminal, disposed between the first side of the frame and the diaphragm, and electrically connected to the second conductive region.

18. The vibrating element as claimed in claim 17, wherein the first terminal and the second terminal are circuit lines on a flexible circuit board, and one ends of the first terminal and the second terminal are folded to the second side of the frame along with folding of the flexible circuit board.

19. The vibrating element as claimed in claim 17, wherein the first terminal and the second terminal are partially embedded in the frame, and one ends of the first terminal and the second terminal penetrate through the frame and are exposed at the second side of the frame.

20. The vibrating element as claimed in claim 19, wherein the frame, the first terminal and the second terminal are formed through insert-injection molding.

* * * * *